US006360793B1

(12) United States Patent
Sugano et al.

(10) Patent No.: US 6,360,793 B1
(45) Date of Patent: Mar. 26, 2002

(54) FAST FILL METHOD AND APPARATUS

(75) Inventors: Hisayuki Sugano; Masami Saruta; Hajime Kishida, all of Iwata (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 09/500,218

(22) Filed: Feb. 8, 2000

(30) Foreign Application Priority Data

Feb. 8, 1999 (JP) ..... 11-030593

(51) Int. Cl.[7] ..... B65B 1/30; B65B 3/28; B65B 57/06; B65B 57/14; B67C 3/00

(52) U.S. Cl. ..... 141/197; 141/18; 141/82; 141/83; 141/94

(58) Field of Search ..... 141/18, 21, 69, 141/70, 82, 83, 94, 95, 98, 192, 197, 234, 236, 248, 47, 49, 51; 62/50.1–50.5; 123/525, 527

(56) References Cited

U.S. PATENT DOCUMENTS 4,528,000 A 7/1985 McGill et al.
5,409,046 A * 4/1995 Swenson et al. ..... 141/11
5,479,966 A 1/1996 Tison et al.
5,542,459 A * 8/1996 Price et al. ..... 141/18
5,641,005 A 6/1997 Kountz et al.
5,901,758 A 5/1999 Hwang et al.

* cited by examiner

*Primary Examiner*—Timothy L. Maust
(74) *Attorney, Agent, or Firm*—Knobbe, Martens, Olson & Bear, LLP

(57) ABSTRACT

A filling apparatus for filling receiving vessels with compressed gas lowers the temperature of the compressed gas in response to the filling pressure of the receiving vessel. As an internal pressure within the receiving vessel approaches a value indicative of a filled vessel, the temperature of the compressed gas is reduced to counter the effect of heat caused by increasing pressure within the vessel. The temperature of the compressed gas is reduced by slowing the compressor and allowing the gas to dwell for a longer period within a heat exchanger between stages of compression. In addition, the temperature of the compressed gas is reduced by increasing the efficacy of the heat exchanger such as by increasing the rate of air flow over the heat exchanger. Accordingly, engine speed, fan speed and compressor speed each can be varied according to various arrangements of the filling apparatus to reduce the temperature of the compressed gases being introduced into a receiving vessel.

46 Claims, 8 Drawing Sheets

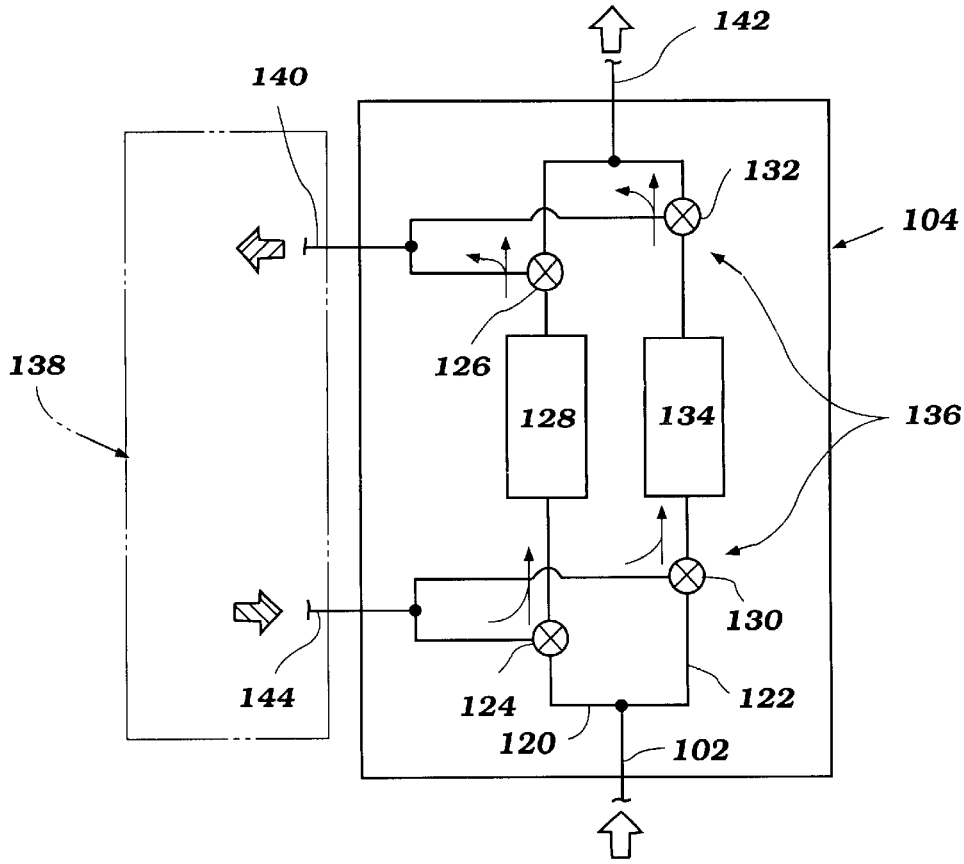
Figure 2
Figure 3(a)
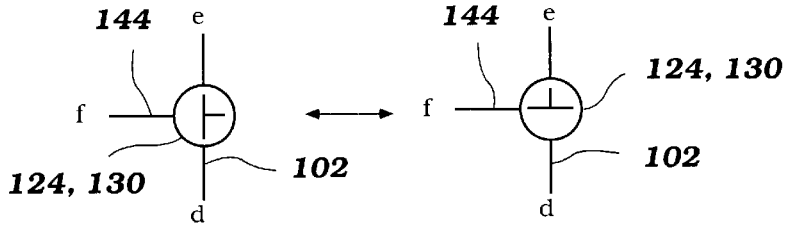
Figure 3(b)
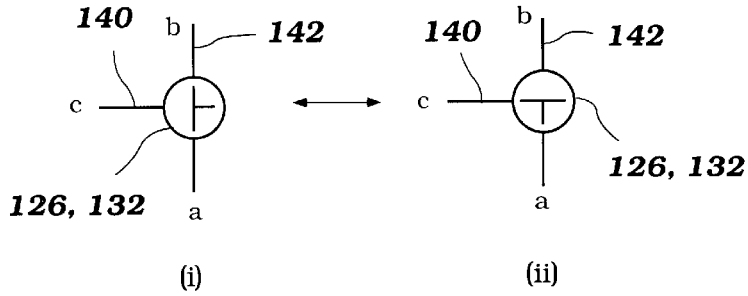

FAST FILL METHOD AND APPARATUS

PRIORITY INFORMATION

This application is based on and claims priority to Japanese Patent Application Nos. 11-030,607, filed Feb. 8, 1999, and 11-030,593, filed Feb. 8, 1999, the entire contents of which arc hereby expressly incorporated by reference. A copy of each of these Japanese applications is attached hereto in an appendix.

FIELD OF THE INVENTION

The present invention generally relates to natural gas compressors. More particularly, the present invention relates to methods and apparatus for fast filling tanks with pressurized natural gases.

BACKGROUND OF THE INVENTION

Gas storage vessels, such as gas cylinders, bottles or tanks, are commonly filled with gases by charging the gas into the vessel until the desired pressure is reached. It is desirable to fill the vessels as quickly as possible, but it is also important to accurately fill the vessels with the target quantity of gas, such as a quantity associated with a completely filled or charged tank. One problem that makes it difficult to accurately measure the amount of gas in a charged gas vessel is the temperature-pressure relationship of contained gases. By virtue of the gas laws, the pressure exerted by a given volume of gas is directly proportional to its temperature. Accordingly, as the temperature of a gas increases, the pressure of the gas also increases. Thus, when filling gas receiving vessels by pressure measurements, it is important that the gas in the receiving, vessel be at or about a preset or ambient temperature when it approaches its "filled" pressure to ensure that approximately the correct amount of gas is charged into the vessel.

Since it is desirable to fill the gas receiving vessel in the shortest possible time, it is customary to immediately open the fill valve to the wide-open position. This causes an immediate blast of gas to enter the empty vessel, which causes the temperature of the gas being charged into the vessel to rise rapidly as the pressure in the vessel increases. Rapid filling of the vessel can not continue to cause a rapid temperature increase throughout the filling, process, and the initially heated gas cools as additional gas expands (i.e., expansion lowers temperature) into the receiving vessel. However, often the as temperature does not return to the ambient temperature during the filling process and, thus, the pressure within the receiving vessel is elevated above the pressure that the receiving vessel ultimately achieves when it returns to ambient temperature. Thus, without allowing the tank to cool after being filled and then checking its pressure, it is difficult to ensure that the vessel has been completely filled for use in ambient conditions. Such cooling often requires substantial time.

In addition, the temperature of the gas within the tank also increases as the pressure within the tank increases during filling. Accordingly, if the temperature of the gas used to fill the tank is maintained substantially constant during the filling process the tank actually begins to increase in temperature. Thus, this heating problem becomes even more evident as the tank approaches a filled pressure level.

Because service-time of the equipment is valuable and because accuracy of tank filling is important, it would be desirable to fill empty gas vessels with natural gas by a method which does not cause a rapid rise of the temperature of the gas when gas is introduced into an empty vessel and to reduce the heating of the receiving vessel resulting from pressure increases within the vessel. Such a technique should allow the tank to be rapidly filled without the need for cooling the vessel after filling.

SUMMARY OF THE INVENTION

Accordingly, one aspect of the present invention involves a natural gas filling apparatus comprising an engine and a compressor. The engine comprises an induction system and an exhaust manifold. The apparatus also comprises an inlet nozzle and a dehumidifier that is connected to the inlet nozzle through a first gas supply pipe. A second gas supply pipe extends between the compressor and the dehumidifier. The dehumidifier comprises a first moisture absorbing filter and a second moisture absorbing filter. A heated air supply is connected to the first filter and the second filter and a heated air return is connected to the induction system. A first switching portion is interposed between the first gas supply pipe, the heated air supply and the first and second moisture absorbing filters, and a second switching portion is interposed between the second gas supply pipe, the heated air return and the first and second moisture absorbing filters. The first portion and the second portion selectively connect the first gas supply pipe and the second gas supply pipe to one of the first filter and the second filter and the heated air supply and the heat air return to the other of the first filter and the second filter. The compressor further comprises multiple compression stages and communicates with a delivery conduit. The delivery conduit connects the compressor to an outlet socket with a gas cooling heat exchanger interposed between at least a portion of the compressor and the delivery conduit. A pressure sensor communicates with the delivery conduit.

Another aspect of the present invention involves a natural gas filling apparatus comprising, an engine and a compressor driven by the engine. The compressor comprises a multiple stage positive displacement compressor and a gas cooling heat exchanger. An outlet valve is adapted to selectively fill removable receiving vessels with compressed gas and a delivery conduit connects the compressor to the outlet valve. A pressure sensor is positioned along the delivery conduit and is in communication with and inputting a pressure signal to a controller. The controller is configured to control an operational characteristic of the compressor when the pressure signal indicates an increase in pressure.

A further aspect of the present invention involves a dehumidifier for use in a natural gas compressor being powered by an internal combustion engine and having an intake system and an exhaust collector. The dehumidifier comprises a gas inlet and a gas outlet. A first branch connects the inlet and the inlet and a second branch connects the inlet and the outlet. A first moisture filter is positioned along the first branch and a second moisture filter is positioned along the second branch. A heated air supply and a heated air exhaust also are collected to the dehumidifier. The heated air exhaust extends between the dehumidifier and is adapted to attach to the intake system. A first three way valve connects the inlet, the supply and the first filter. A second three way valve connects the inlet, the supply and the second filter. A third three way valve connects the outlet, the exhaust and the first filter. A fourth three way valve connects the outlet, the exhaust and the second filter.

Another aspect of the present invention involves a natural gas filling apparatus comprising an engine, a compressor driven by the engine and a gas cooling heat exchanger. The compressor comprises a multiple stage compressor and an outlet valve that is adapted to selectively fill a removable receiving vessel with compressed gas from the compressor. A delivery conduit connects the compressor to the outlet valve. Means for detecting a degree to which the vessel is filled with compressed gas are provided as are means for adjusting a temperature of the gas being delivered to the vessel through the delivery conduit in response to the degree to which the vessel is filled with compressed gas.

A further aspect of the present invention involves a method of fast filling, a container with compressed gas comprising driving a compressor with an engine. The method also involves providing a stream of compressed gas from the compressor to a receiver vessel and monitoring a pressure of the stream of compressed gas. The method further involves decreasing the temperature of the stream of compressed gas as the pressure of the stream of compressed gas increases above a preset pressure.

BRIEF DESCRIPTION OF THE DRAWINGS

These and other features aspects and advantages of the present invention now will be described with reference to the drawings of preferred arrangements which arrangements are intended to illustrate and not to limit the present invention, and in which drawings:

FIG. 2 is a schematic illustration of a dehumidifier of the apparatus of FIG. 1:

FIGS. 3(*a*) and 3(*b*) are schematic illustrations of valving arrangements used in the dehumidifier of FIG. 2;

DETAILED DESCRIPTION OF SEVERAL PREFERRED EMBODIMENTS OF THE PRESENT INVENTION

Figure 1:
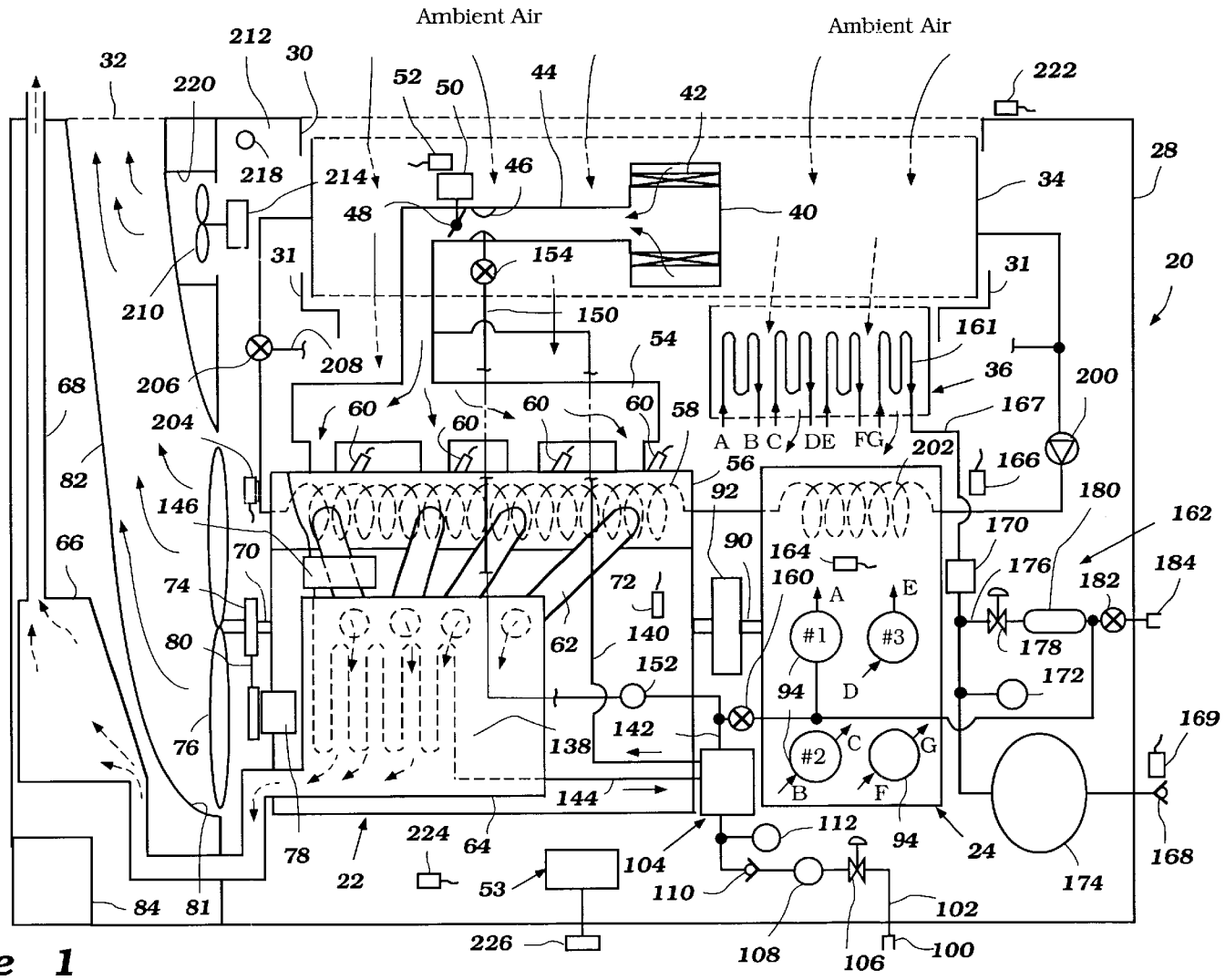
FIG. 1 is a schematic illustration of a gas filling apparatus configured and arranged in accordance with certain features aspects and advantages of the present invention.

With reference now to FIG. 1, a natural gas receiving vessel filling apparatus 20 is illustrated therein. The filling apparatus 20 has particular utility in natural gas applications but, as will be recognized by those of ordinary skill in the art, also can have utility in other applications as well. The filling apparatus 20 is advantageously adapted to fast-fill pressurized carrying tanks of natural gas for use in automobiles (i.e., taxis), buses, and other vehicles, for instance. While various arrangements are described below, common to each of the arrangements is that the filling apparatus 20 exploits the natural properties of natural gas to substantially completely fill a carrying tank or receiving, vessel in a short length of time. More specifically, the compressed gas is cooled to an increasing degree as the receiving vessel is being filled. Thus, the cooler gas can counteract the heating of the receiving vessel caused by pressure increases within the receiving vessel. Accordingly, the pressure within the receiving vessel decreases and more gas can be added more rapidly.

With continued reference to FIG. 1, the filling apparatus generally comprises an internal combustion engine 22 that powers a compressor 24. The engine 22 and the compressor 24 preferably are housed within a single case 28 but can be independently housed if desired. The illustrated engine 22 desirably is adapted to run on natural gas. Of course, in some applications, the engine can run on other fuels or can be replaced by an electric motor; however, using natural gas to power the engine 22 affords certain economies in construction and operation of the illustrated apparatus 20 not afforded by other fuels or even electricity. In addition, using natural gas reduces pollution resulting from powering the apparatus 20, which complements the use of the tanks of natural gas that the present invention is filling. with continued reference to FIG. 1, the illustrated casing 28 forms a protective housing about the engine and compressor and desirably includes an ambient air intake duct 30 and an exhaust duct 32. Preferably, the ambient air intake duct 30 is positioned on an upwardly facing surface of the casing 28 and extends downward to an internal duct 31; however, in some applications, the intake duct 30 can be positioned on a side or bottom surface of the filling apparatus 20. Similarly, the illustrated exhaust duct 32 is positioned on an upwardly facing surface of the casing 28. Such a positioning aids in the removal of exhaust gases, fumes and heated air. Of course,other arrangements can also be used depending upon the specific application and environment of use.

Air flowing in though the intake ducts 30,31 is routed through the case 28 in any of a number of directions. For instance, air flowing through the intake duct 30 can pass through a radiator 34 that forms a portion of a water cooling system, which will be described in more detail below. At least a portion of the air also can pass through a heat exchanger 36, which forms a portion of a compressor cooling system that also is described in more detail below. Moreover, at least a portion of the ambient air can be drawn over the engine 22 and/or can be used to otherwise ventilate a chamber defined by the casing 28. Finally, at least a portion of the ambient air can be drawn into an induction system of the engine for combustion with fuel. Each of these systems will now be described in detail, beginning with the engine 22.

With continued reference to FIG. 1, the engine 22 has an induction system that supplies an air/fuel mixture for combustion. The induction system comprises an air intake box 40 that preferably includes an air filter 42. Air drawn into the air intake box 40 is sucked through an intake pipe 44 and passed through a fuel-mixing device 46. In the illustrated arrangement, the fuel mixing device 46 is a venturi such as that used in carbureted engines; however, it is anticipated that the fuel mixing device 46 also could be a fuel injector and could be positioned in other locations depending upon the fuel being used and the desired operational characteristics. When using natural gas as a fuel, the preferred positioning of the venturi 46 is upstream of a throttle valve 48. Fuel is supplied to the fuel-mixing device 46 in a manner that will be described below.

The throttle valve 48 regulates the flow rate of the air/fuel mixture through the induction system and thereby can control the speed of the engine 22. As is generally known, incrementally closing the throttle valve 48 decreases the flow rate through the induction system while opening the throttle valve 48 increases the flow rate through the induction system. The throttle valve 48 typically is formed of a throttle plate that rotates about a throttle shaft. Of course, in some applications the plate of the throttle valve 48 is provided with a series of holes or perforations to allow a fixed amount of air/fuel mixture to pass through the induction system even with the throttle valve 48 completely closed. Also, in some applications, the engine speed could be controlled by the amount of fuel being sent into the induction system. For instance, the engine could feature a fuel injection system (i.e., direct or indirect) and the amount of fuel injected could be varied to alter the engine speed.

Movement of the illustrated throttle valve 48 preferably is controlled by an operator or control unit through a drive motor 50. The motor 50 is designed to cycle the throttle valve 48 between positions by moving the throttle shaft depending upon the desired engine speed (and therefore the desired air/fuel flow rate). A throttle position sensor 52 can be attached to the motor 50 or to the throttle shaft in such a manner that the position or a change of position is registered by the controller 53. The controller 53, in turn, can control the relative positioning of the throttle valve 48 by manipulating the motor 50.

The air/fuel mixture is delivered to each individual cylinder of the illustrated engine through a common plenum chamber 54. While other arrangements are also contemplated (i.e., individual throttle valves between the plenum chamber and the respective cylinders), the illustrated arrangement allows a more consistent air-fuel mixture to be supplied from cylinder to cylinder.

The air/fuel charge passes from the plenum chamber 54 into the individual combustion chambers of the respective cylinders through passages formed in a cylinder head 56. The illustrated cylinder head 56 is attached to the balance of the engine 22 in any suitable manner. In addition, the cylinder head 56 preferably is water-cooled. For instance, the cylinder head can include coolant jackets that allow coolant to course through the cylinder head 56 such that the water draws heat away from the cylinder head 56. The coolant jackets, represented schematically in FIG. 1 and identified by the reference numeral 58, form a portion of a cooling system that will be described in greater detail below.

With continued reference to FIG. 1, a set of spark plugs 60 corresponding to the combustion chambers are mounted in the illustrated cylinder head 56. The spark plugs 60 form a portion of a suitable ignition system. The ignition system is used to ignite the air/fuel charge that is intermittently transferred into the combustion chambers. The ignition system operates in any known manner and can be advanced or delayed as desired. Preferably, an ignition control circuit 240 (see FIG. 4) is controlled by the controller 53 depending upon the desired operating characteristics for the engine 22. In addition, in some applications, glow plug,s can replace the spark plugs and the engine can feature non-spark ignited ignition systems (i.e., compression ignition).

Following combustion, the combustion chambers are filled with exhaust gases. The exhaust gases are carried to the atmosphere through a suitable exhaust system. With reference to FIG. 1, the illustrated exhaust system comprises a set of exhaust runners 62. The exhaust runners 62 connect to the cylinder head 56 and allow gases flowing through exhaust passages formed in the cylinder head 56 to flow into an exhaust manifold or collector 64. The exhaust gases can circulate in the collector 64 before flowing through a silencer 66 and out of the case 28 through an exhaust pipe 68. As will be recognized by those of ordinary skill in the art, other exhaust system configurations also can be used; however, as will be explained, the illustrated collector 64 also is useful as a heating element. In addition, some components? such as the silencer 66 and the exhaust pipe 68 can be formed as passages in the case 28 rather than being formed of individual tubular components. Moreover, other exhaust system variations will become readily apparent to those of ordinary skill in the art.

As is known, the engine 22 generally comprises a set of pistons that are associated with the cylinders. It should be noted that the illustrated engine 22 is a four cycle—four cylinder reciprocating type of engine. Of course, other types of engines also can be used. However, the illustrated engine 22 generally comprises a set of pistons that are associated with respective cylinders. The pistons are moved by combustion within the combustion chambers in a known manner and the reciprocating movement of the pistons within the cylinders is transferred to an output shaft or crankshaft 70 through connecting rods. The crankshaft is journaled within a crankcase (not shown) in any suitable manner and an engine speed sensor 72 is positioned proximate the crankshaft 70 to monitor the speed of the crankshaft 70. The engine speed sensor 72 can comprises a magnet and pick-up arrangement or any other suitable arrangement and its output is received and monitored by the controller 53.

A first end of the illustrated crankshaft 70 carries a pulley 74 and a main ventilation fan 76. The pulley 74 is drivingly connected to a generator 78 through a flexible transmitter 80, such as a belt, for instance. Of course, the crankshaft 70 can drive the generator 78 through a gear train, a chain and sprocket arrangement or any other suitable transmission. The generator 78 creates electrical power when the crankshaft 70 is turning at a sufficient speed. The electrical power can be used to power a number of components, as will be explained. In addition, the electrical power created by the generator 78 can also be used to recharge a battery or other power storage cell 84 in any suitable manner. Moreover, in some forms, the generator 78 can be powered by the storage cell 84 to act as a starter for the engine 22 when directed to by the controller 78.

The main ventilation fan 76 draws air through the chamber defined by the case 28 and thereby augments circulation through the case 28. As the illustrated fan 76 is directly connected to the crankshaft 70, the speed of the fan 76 is directly related to the speed of the engine 22. In other words, as the engine speed increases, so too does the fan speed. The fan is positioned proximate a main exhaust port 81 and blows air out of the case 28 through a main ventilation exhaust conduit 82 that terminates at the exhaust duct 32 formed at the surface of the case 28.

The other end of the crankshaft 70 is coupled to an input shaft 90 of the compressor 24 through a suitable coupling member 92. In the illustrated arrangement, the input shaft 90 and the crankshaft 70 are joined together by an electromagnetic clutch 92. The electromagnetic clutch 92 ensures that the clutch is not engaged until the clutch can be energized. The present clutch 92 is controlled by the controller 53. Of course, other clutching arrangements also can be used. In addition, as will be explained, the input shaft 90 and the crankshaft 70 can be coupled directly without an intervening clutching arrangement.

The rotational power of the crankshaft 70, therefore, is selectively provided to the compressor 24 and can be used to selectively power the positive displacement type compression pumps 94. More specifically, the input shaft 90 drives the pumps 94 in any suitable manner, such as through a connecting rod and piston arrangement similar to that featured in the reciprocating internal combustion engine described above. The pumps 94 preferably are arranged in sequence such that they increase gas pressure in stages. For instance, pump #1 generates a first pressure while pump #2 generates a second pressure that is higher than the first pressure. Pump #3 and pump #4 also incrementally increase the pressure such that a large pressure differential can be accomplished between the intake into pump #1 and the outlet of pump #4. Of course, the relative pressure increases can be varied according to desired design features. For instance, each pump can increase the pressure by substantially the same amount. Alternatively, each pump can increase the pressure by varying amounts.

With continued reference now to FIG. 1, a gas flow path through the apparatus 20 will be described in detail prior to describing the operation of the illustrated apparatus 20. Natural gas is introduced into the illustrated apparatus 20 through the inlet port 100. This port 100 can be a nipple, quick disconnect, screw, lure lock or any other suitable type of connecting port 100 that securely connects a supply of natural gas (or other type of gas or vapor depending upon the application) to the apparatus 20.

The gas flows through the port 100 into a first line 102. The first line 102 generally connects the port 100 to a dehumidifier 104; however, a gas supply control valve 106, a gas flow meter 108 that registers the amount of gas flowing through the first line 102 and a check valve 110 that prevents back flow of gas through,I the first line 102 are positioned between the port 100 and the dehumidifier 104. Preferably, a first, or inlet, gas line pressure sensor 112 is also positioned along the first line 102. More preferably, the inlet pressure sensor 112 is positioned upstream of the dehumidifier 104 but downstream of the check valve 10. The gas flow meter 108 and the pressure sensor 112 send their signals to a controller, 53 as will be discussed. In addition, the gas supply control valve 106 preferably is controllable using the controller 53.

With reference now to FIGS. 2, 3(*a*) and 3(*b*), flow paths through the dehumidifier 104 will be described in greater detail. As explained directly above, natural gas flows into the dehumidifier 104 through the first line 102. Within the illustrated dehumidifier, the first line 102 is split into a first branch 120 and a second branch 122. The first branch 120 generally comprises a first three way valve 124 and a second three way valve 126 with a first water vapor filter 128 interposed therebetween. Similarly the second branch 122 generally comprises a third three way valve 130 and a fourth three way valve 132 with a second water vapor filter 134 interposed therebetween. Together, the first, second, third and fourth three way valves, 124, 126, 130. 132 form a switching arrangement 136. The switching arrangement 136 can be manipulated by the controller 53, as will be explained in more detail below, to divert a preset volume of gas into a heater 138 such that the at least a portion of the entrained water vapor in the natural gas can be removed. The two water vapor filters 128, 134 desirably include a material, such as silica, for instance, that can be cycled between absorbing liquid and releasing liquid, and preferably are housed in suitable chambers.

With initial reference to FIG. 3(*b*), the operation of the second and fourth three way valves 126, 132 will be described. As illustrated, the three way valves 126, 132 desirably only allow flow to occur in two directions: straight through or to one side. More specifically, with each of the ports labeled a, b and c, the valves either allow flow from a to b or from a to c. If the valves 126, 132 are positioned as in FIG. 3(*b*)(i) to allow flow from a to b, the gas will flow into a compressor inlet pipe 142 while back-flow from a heater exhaust pipe 140 is blocked. If the valves 126, 132 are positioned as in FIG. 3(*b*)(ii) to allow flow from a to c, the heated air will flow into the heater exhaust pipe 140 while back-flow is blocked from the compressor inlet pipe 142. Although the valves 126, 132 have been described together, as will be explained below, the valves 126, 132 actually move independent of one another and generally move such they are in opposing positions.

With reference now to FIG. 3(*a*), the valves 124, 130 also move in similar manners. More specifically, with each of the ports labeled d, e and f, the valves either allow flow from d to e or from f to e. If the valves 124, 130 are positioned as in FIG. 3(*a*)(i) to allow flow from d to e, the gas will flow into the respective water vapor filter element 128, 134 while flow from a heater inlet pipe 144 is blocked. If the valves 124, 130 are positioned as in FIG. 3(*b*)(ii) to allow flow from f to e, air from the heater will flow into the respective water vapor filter element 128, 134 while flow is blocked from the first line 102. Again, although the valves 124, 130 have been described together, as also will be explained below, the valves 124, 130 actually move independent of one another and generally move such they are in opposing positions.

An air cleaner 146 is positioned at an air inlet to the heater. Having passed through the air cleaner 146, the air circulates through the exhaust collector 64 in the heater inlet pipe 144 and is warmed by the exhaust gases passing adjacent to the heater inlet pipe 144 within the exhaust collector 64. The exhaust collector 64 and inlet pipe 144 form a heat exchanger that is used to elevate the temperature of the air for reasons that will be appreciated. Thus, air at a highly elevated temperature is transferred into the dehumidifier.

With reference now to FIG. 1, the balance of the heater 138 will be described. As mentioned, heated air is routed from the dehumidifier 104 by the valves 126, 132 into the heater exhaust pipe 140. The exhaust pipe 140 preferably extends proximate to or through a portion of the engine to a portion of the induction system.

With reference again to FIG. 2, a mode of operation of the illustrated dehumidifier will be explained. Gas is transferred into the dehumidifier 104 through the first line 102. One of the valves 124, 130 is initially closed with respect to flow from the first line 102 (i.e. positioned as in FIG. 3(*a*)(i)) while the other is initially opened with respect to flow from the first line 102 (i.e., positioned as in FIG. 3(*a*)(ii)). For instance, valve 124 is initially closed and valve 130 is opened. Additionally, the corresponding one of valves 126, 132 is positioned in a like manner. For instance, two valves 124, 126 are initially closed while two valves 130. 132 are initially. Thus, a closed loop is formed through the two valves 124, 126, the water vapor filter 128 and the heater 138 and an open path is formed through the other two valves 130, 132 and the water vapor filter 134.

As the gas flows through the water vapor filter element 128 into the inlet pipe 142 (which supplies natural gas to the engine for combustion and to the compressor for compression), water vapor is removed from the gas by the selected one of the water vapor filter elements 128, 134. After the compressor 24 has received a preset volume of compressed natural gas from the gas supply, the valves are switched and the two valves 124. 126 allow heated air to flow through the water vapor filter element which previously was absorbing water vapor while natural gas flows through the other water vapor filter element. The heated air drawn through the water vapor filter element evaporates the water being held therein and carries it away, thereby reconditioning or restoring the water filter element The heated air is moved by the lower pressure within the induction system into which the heated air and absorbed water is transferred.

Importantly, when the switching arrangement 136 switches the water vapor filter element that is being used, the residual gas vented with the heated air and water vapor are transferred into the induction system. Accordingly, pollution caused by entrained and residual natural gas that is left within a chamber encasing the water vapor filter (and the corresponding piping) during restoration of the water vapor filter (i.e. passing heated air through the filter) is reduced or eliminated. More specifically, because the entrained and natural gas is carried to the induction system and combusted by the engine the emissions caused by the filter restoration process can be greatly reduced or eliminated.

With reference again to FIG. 1, natural gas is supplied to the engine though the fuel-mixing device. As the gas flows into the compressor inlet pope 142, a fuel supply line 150 carries gas up to the induction system. A pressure reducer 152 and a fuel line control valve 154 are positioned along the fuel supply line 150. The pressure reducer 152 steps the pressure of the natural gas down to a lower and more useable level. The fuel line control valve 154 is used to increase or decrease the supply of fuel to the fuel-mixing device 46 and can be selectively controlled by the controller 53 depending upon the desired operating characteristics of the engine 22.

With reference now to the lower right hand corner of FIG. 1, natural gas exits the dehumidifier 104 and enters the compressor 24 through the compressor inlet pipe 142. The inlet pipe 142 branches into two feeds: one to the first of the compression pumps 94 and the second to a blow-down arrangement 162, which will be described below. A cut-off valve 160, which can be controlled by the controller 53, is positioned along the second branch of the inlet pipe 142 to allow the gas supply to the compressor to be terminated independently of the gas supply to the engine 22.

Natural gas is fed into the first of the pumps 94. The first pump #1 compresses the gas, preferably in a substantially adiabatic manner. As the gas is compressed, the temperature of the gas increases as does the temperature of the compressor 24. The temperature of the compressor 24 is monitored by a first temperature sensor 164, the output of which is sent to the controller 53. Additionally, the compressor is liquid cooled through a cooling system that will be described below.

Following the first compression, the gas is transferred to the air-cooled heat exchanger 36 in the illustrated arrangement as indicated by the reference letters A—A. As described above, the heat exchanger 36 is generally air cooled by air drawn through the air intake duct 30 by the fan 76. The gas flows through a coil 161 of the heat exchanger 36 and is returned to the second pump #2 of the compressor 24 as indicated by the reference letters B—B. Desirably, the temperature of the gas has been reduced by the heat exchanger 36.

Again, the pump compresses the gas, preferably in a substantially adiabatic manner. As the gas is compressed, the temperature of the gas typically increases as does the temperature of the compressor 24. The gas thus is returned to the heat exchanger 36 as indicated by the reference letters C—C. This process is then repeated for pumps #3 and #4 with return to the heat exchanger as indicated by the reference letters D—D) and E—E, and by reference letter F—F and G—G, respectively.

Following the final stage of compression and the final cooling pass through the heat exchanger 36, the temperature of the compressed natural gas is measured by a second temperature sensor 166, the output of which is sent to the controller 53. The compressed natural gas is then transferred through a high-pressure line 167 to a receiving storage vessel (not shown) through a filling coupling socket 168. This socket 168 can be a nipple, quick disconnect, screw, lure lock or any other suitable type of socket that securely connects a vessel to the apparatus 20 for filling. Interposed between the filling coupling socket 168 and the outlet of the heat exchanger 36 are a filter 170, a final pressure sensor 172 and an outlet flow volume meter 174. The significance of each of these components will become apparent. Desirably, the filter 170 removes lubricant and other impurities from the compressed gas flow, such as debris, foreign matter and liquid, for instance. In addition, the significance of a vessel connection confirmation sensor 169 will also become apparent. The pressure sensor 172, the meter 174 and the confirmation sensor 169 each transmit a signal to the controller 53. As used herein, "transmit" shall include, but not be limited to, either directly (i.e. through data lines), indirectly (i.e., through infrared-type signals) and mechanically (i.e. the lumens).

The signal transmitted by the pressure sensor 172 can be indicative of an absolute pressure, a pressure change or any combination of the two. The pressure sensor 172 can also be formed as a tube to transmit pressure changes through the tube or can be any other suitable construction, the pressure sensor can transmit information regarding the pressure within the supply line or, in some applications, actually transmit information regarding the pressure within the receiving vessel.

A branch 176 extends from high-pressure line 167 to the blow-down arrangement 162. A blow-down control valve 178 selectively separates the high-pressure line 167 from the supply line 142, which is at a much lower pressure. During purging and cleaning, the shut-off valve 160 can be closed and the purge process controlled by the blow-down control valve 178. For instance, opening the valve 178 will allow the high-pressure gas contained within the high-pressure line 167 to escape into a blow-down tank 180 until the pressure differential is eliminated. In case of a sudden change in pressure within the blow-down tank 180, a pressure relief valve 182 and escape port 184 are provided. The valve 182 can be opened by the controller 53. When the valve 182 opens and the valve 178 is opened by the controller 53, gas (and the attendant high pressure) is allowed to escape through the port 184. As will be recognized by those of ordinary skill in the art, the valve 178 can be opened to equalize the pressure (i.e., to lower the pressure on the high pressure side of the compressor) such that removal and replacement of vessels will be eased.

With continued reference to FIG. 1, the water cooling system that is used to cool both the compressor 24 and the head 56 of the engine 22 in the illustrated arrangement will be described. Coolant, water in the present arrangement, is circulated throughout the water cooling system with a low-pressure coolant pump 200. The coolant also could comprise additional or alternative materials known to those of ordinary skill in the art. Preferably, the pump 200 is electric and is powered by the generator 78 and controlled by the controller 53; however, the pump could be driven in other manners, such as from the crankshaft 70 or the input shaft 90 for instance.

The pump 200 circulates the coolant through cooling jackets 202 formed in the compressor and then through cooling jackets 58 formed in the engine 22. As the coolant exits the engine cooling jackets 58, the temperature of the coolant is monitored by a third temperature sensor 204. The temperature sensor 204 transmits its output to the controller 53.

The coolant then passes through a redirecting thermostat 206, which can be a three way linear valve that is controlled by the controller 53. As will be recognized, the thermostat 206 also can be temperature-activated (i.e., such as those use in automobiles) such that the thermostat mechanically opens and closes a flow route depending upon the temperature of the coolant impinging upon its surfaces. The thermostat 206 directs coolant through a bypass 208 to increase the temperature of the coolant to a desired level or through the radiator 34 to decrease the temperature of the coolant to a desired level. Accordingly, by controlling the flow through both the bypass 208 and the radiator 34, the temperature of the coolant can be manipulated as desired. As explained above, the radiator 34 is desirably positioned within the air inlet duct 30 formed in the case 28 and above an intake duct 31.

With reference to the upper left hand corner of FIG. 1, an auxiliary ventilation fan 210 is positioned in a gas trap 212 formed in the case 28. Preferably, the gas trap encircles, or at least partially encircles openings extending through the upper surface of the case 28. In addition, while more than one gas trap 212 can be used, preferably, all gas traps are vented using exhaust fans if a sufficient level of gas builds within the trap. The fan 210 preferably is powered by a small electric motor 214 and is controlled by the controller 53 (see FIG. 4) in response to a signal created by a gas sensor 218 that is also positioned within the gas trap 212. The signal is sent to the controller 216. When a preset level of gas is detected within the gas trap 212 by the sensor 218, the controller 53 activates the electric motor 214 to vent the gas through an auxiliary duct 220. Additionally, an alert can be issued by the controller 53 to draw attention to the condition.

The filling apparatus also can comprise an ambient air temperature sensor 222 and an inner chamber temperature sensor 224 to detect the corresponding temperatures during use. The temperatures of both the ambient air and the operating temperature of the inner chamber both can have an impact on the requisite pressure to be achieved through the present filling device such that a substantially complete fast fill can result. Moreover, the filling apparatus 20 also includes an on-off switch 226 that renders the apparatus 20 operational or not operational. Both of the temperature sensors 222, 224 and the switch 226 communicate with the controller 53 to send their respective signals to the controller 53.

Figure 4:
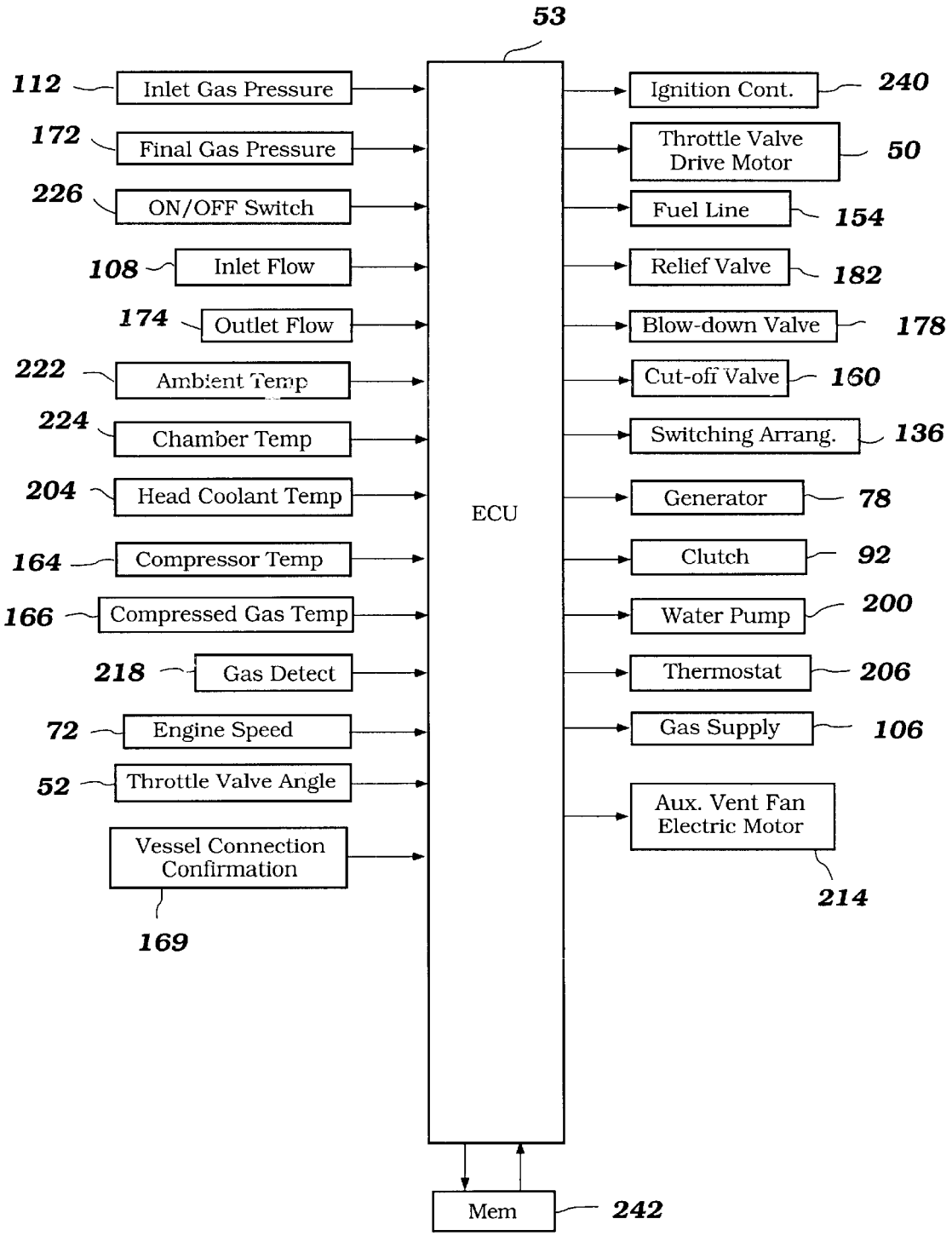
FIG. 4 is a schematic illustration of an exemplary controller with certain inputs and outputs being shown.

The above-discussion interrelated several components with the controller 53. The controller 53 can take the form of a microprocessor, a set of logic circuits, or any other suitable construction. Importantly, the controller communicates with a memory location 242 as shown in FIG. 4. The memory location includes a map of preferred operating conditions that are used to track the performance of the filling apparatus 20 more closely to that of preset preferred operating conditions. For instance, the engine speed can be varied to vary the flow rate through the compressor. 13y varying the flow rate through the compressor of FIG. 1, the dwell time within the heat exchanger 36 can be altered. Thus, slowing the engine speed would increase the dwell time within the heat exchanger 36 between stages of compression and, therefore, increase the efficacy of the heat exchanger 36 such that the temperature of the compressed natural gas can be increasingly reduced and the introduction rate of compressed natural gas to a vessel can be increased. The increase in introduction rate, while seemingly counterintuitive, arises due to a reduction in pressure within the vessel resulting from the decrease in temperature within the vessel that arises from cooling the gas before it is introduced into the vessel (i.e., for gases, temperature and pressure vary in a proportionate manner).

Figure 5:
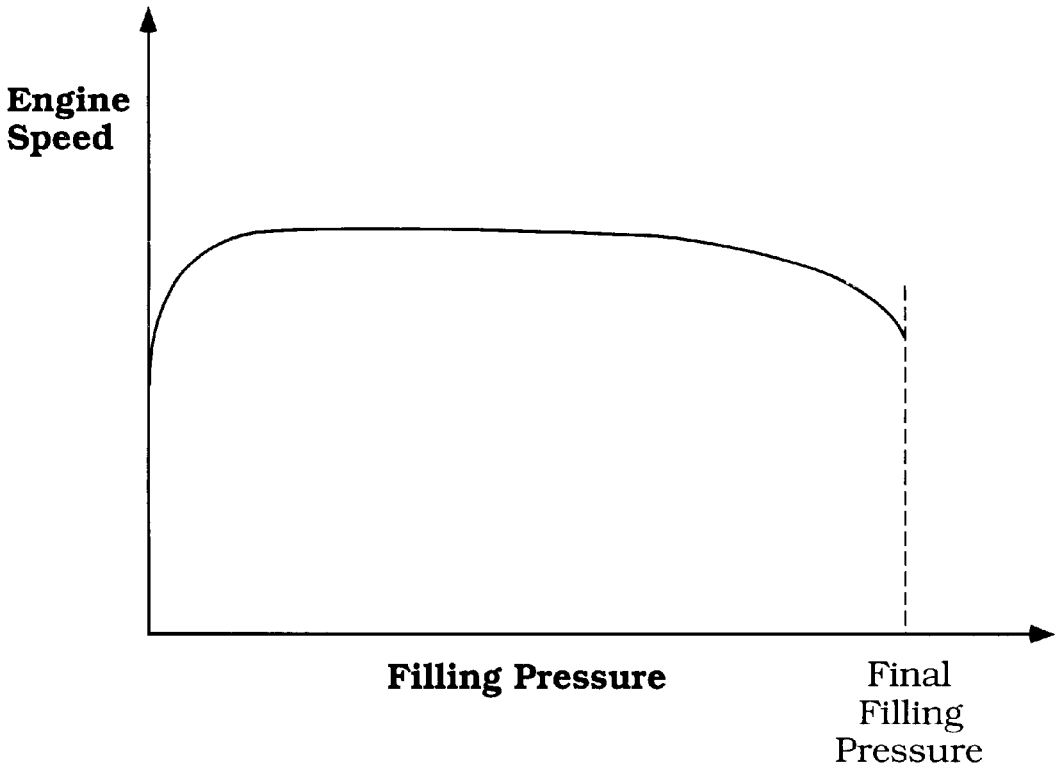
FIG. 5 is a graphical depiction of a preferred relationship of engine speed with respect to increasing filling pressure within a receiving vessel.

With reference now to FIG. 5, a preferred filling curve is illustrated therein. The curve graphically depicts a desired engine speed as a function of the measured filling pressure sensed during the filling operation. As shown, the engine operates at its slowest speeds during the initial phases of filling. This low speed operation both increases the pre-cooling of the natural gas within the heat exchanger 36 and slows the rate at which the gas is being expelled into the receiving vessel. The combination of these two properties greatly reduces the temperature increase associated with the initial charging of the empty receiving vessel over simply slowing the introduction rate. Accordingly, the introduction rate can be increased over methods not pre-cooling the natural gas prior to initial charging of the receiver vessel.

With continued reference to FIG. 5, the engine speed in increased as the pressure within the receiving vessel increases. The increasing engine speed peaks fairly early in the filling process and slowly declines after that point. The declining engine speed both slows the introduction to allow built-up heat to dissipate and decreases the introduction temperature of the gas by enabling a prolonged dwell within the heat exchanger between each stage of pressurization and after pressurization. Finally, as the receiving vessel approaches a final filling pressure, the engine speed, and therefore compressor speed, is rapidly decreased. The effect of this decrease helps the final amounts of natural gas to cool the natural gas already transferred into the receiving vessel and allows more natural gas to be packed into the receiving vessel without undue heat build-up and the associated expansion. In particular, as described above, decreasing the temperature within the vessel also decreases the pressure, which results in easier charging of the vessel with additional gas.

Figure 6:
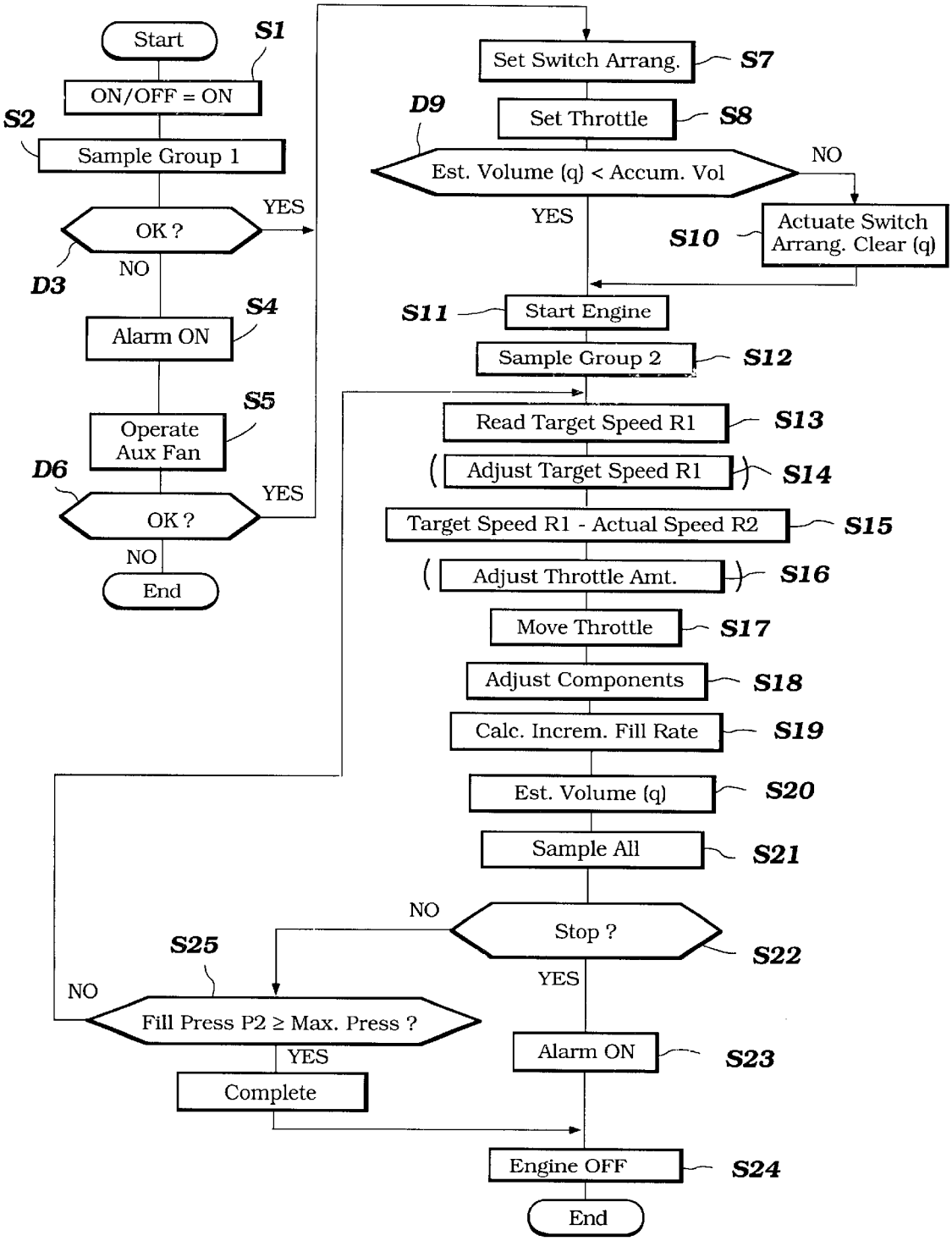
FIG. 6 is an exemplary control routine having certain features aspects and advantages in accordance with the present invention.

With reference now to FIG. 6, a routine associated with the above-described filling apparatus 20 will be described in detail. To begin the fill operation, the on/off switch 226 is flipped to the on position in a step S1. The controller is then activated and powered up with energy at least initially supplied by the battery in the illustrated arrangement.

Upon powering up, the controller performs an initial systems check in a step S2. During this initial system check, the controller samples the data being reported by the inlet gas pressure sensor 112, the gas detector 218 and the vessel connection confirmation sensor 169. Thus, the controller establishes whether the fill apparatus is operational. If no gas pressure is sensed by the inlet gas pressure sensor, then the fill apparatus cannot be operated. Moreover, if gas has leaked and been collected within the gas trap 212, the gas preferably is evacuated prior to operation of the fill apparatus. In addition, the filling apparatus 20 is not run without a receiving vessel being properly positioned to receive the output from the filling apparatus 20.

After sampling the data from these three sensors, the controller 53 determines whether the system is ready for operation in a decision block D3. In the event that the controller 53 determines that there is a problem, an alarm is activated in a step S4. The alarm can comprise any of the following, or a combination of any of the following: lights, buzzers, digital readouts, or any other tactile, visual or auditory alerts. After activating the alarm, the controller activates the auxiliary ventilation fan motor to evacuate the gas trap 212 in a step S5. The controller can then check to see if the condition causing the alarm has been corrected in decision block D6. This recheck can be repeated after a period of time or can be performed just once during each cycle. In addition, this recheck can be performed just once after a preset period has elapsed. If the problem causing the alarm persists, the routine ends.

If the initial check or the recheck results in an all-clear evaluation, the routine continues on to a step S7. In step S7, the controller sets the valves throughout the compressor 24 into a preset initial position. For instance, the cut-off valve 160 is opened, the blow-by valve 178 is closed, the relief valve 182 is closed and the thermostat 206 is positioned to bypass the radiator 34.

Next, after the valves are placed in their initial positions, the controller 53 sets the throttle valve in the starting position during a step S8.

In a decision block D9, the controller 53 compares the estimated volume of gas q used since the last drying cycle in the dehumidifier (i.e., a value from memory) with the preset volume (i.e., the volume of gas corresponding to a volume close to an upper end of a range in which a single one of the water vapor filter elements 128, 134 can effectively remove sufficient water vapor from the gas). If q is greater than the preset volume, then the switching arrangement 136 is placed in a configuration to dry the filter of the dehumidifier 104 that was most recently in use in a step S10. If, on the other hand, q is less than the preset volume, then the controller moves on without switching the filter of the dehumidifier.

The engine 22 is then started in a step S11 and the engine speed sensor 72, final gas pressure sensor 172, outlet flow volume meter 174 and the temperature sensors 164, 166, 204, 222 and 224 are sampled in a step S12. These sensors provide feedback that is used to control the engine speed in view of the desired final gas pressure and temperature.

In steps S13 and S14, a target engine speed R1 is read from a map stored in the memory 242 and then adjusted. The map tracks preferred engine speeds based at least upon the output of the final gas pressure sensor. In some arrangements, the map also incorporates information based on the relative temperatures such that their effect on the final gas pressure can be accommodated. In yet other arrangements, the map also reflects the approximated percentage of full volume that has being supplied by the fill apparatus. The target speed R1 is altered within the controller 53 based upon the value from the map. The target speed can be altered based on relative temperatures and approximated completion percentages such that the target speed considers some or all variable factors.

In a step S15, the difference between the target engine speed R1 and the actual engine speed R2 is calculated. Eased upon this difference, the amount of throttle valve movement required is determined and then the throttle valve is actuated in steps S16 and S17 respectively. It should be appreciated that the engine speed can also be varied in other methods, such as altering ignition timing, for instance.

In a step S18, other actuators are manipulated by the controller 53. For instance, the thermostat 206 could be adjusted. If the flow through the bypass is increased, then the temperature of the elements being cooled by the cooling system (i.e., compressor 24 through the heat exchanger 36) will be elevated while if the flow through the bypass is decreased, then the temperature of those elements will be lowered.

The incremental rate of chance in filling pressure is then calculated by the controller in a step S19. This incremental rate of change is the square of the change in pressure over the change in time, the incremental rate of change is then used by the controller to determine the estimated gas filling volume expelled in a step S20.

All of the sensors are sampled in a step S21 and, based upon this sampling, the controller determines whether the filling process should be stopped in a decision block D22. For instance, if the gas supply were depleted or it the receiving vessel were disengaged from the filling apparatus, the controller would initiate an alert sequence and shut down the engine in steps S23 and S24 respectively.

If the controller 53 determines that the continued operation of the filling apparatus is acceptable, then the controller determines in a decision block 125 whether the filling pressure being sensed is higher than a maximum pressure that should be used. If not, then the routine repeats at step S13. If the pressure is higher than or equal to the maximum pressure, then the controller 53 signals that the receiving vessel is full in a step S26, the engine is turned off in a step S24 and the routine comes to an end.

Through the implementation of this routine, the controller maintains a high degree of safety and system integrity. In addition, the controller is capable of closely tailoring the engine speed, and thus, the temperature and rate of flow of the natural gas as a function of the fill completion percentage. Thus, the controller is being used to help achieve a substantially filled receiver vessel although the receiver vessel is being fast-filled.

Figure 7:
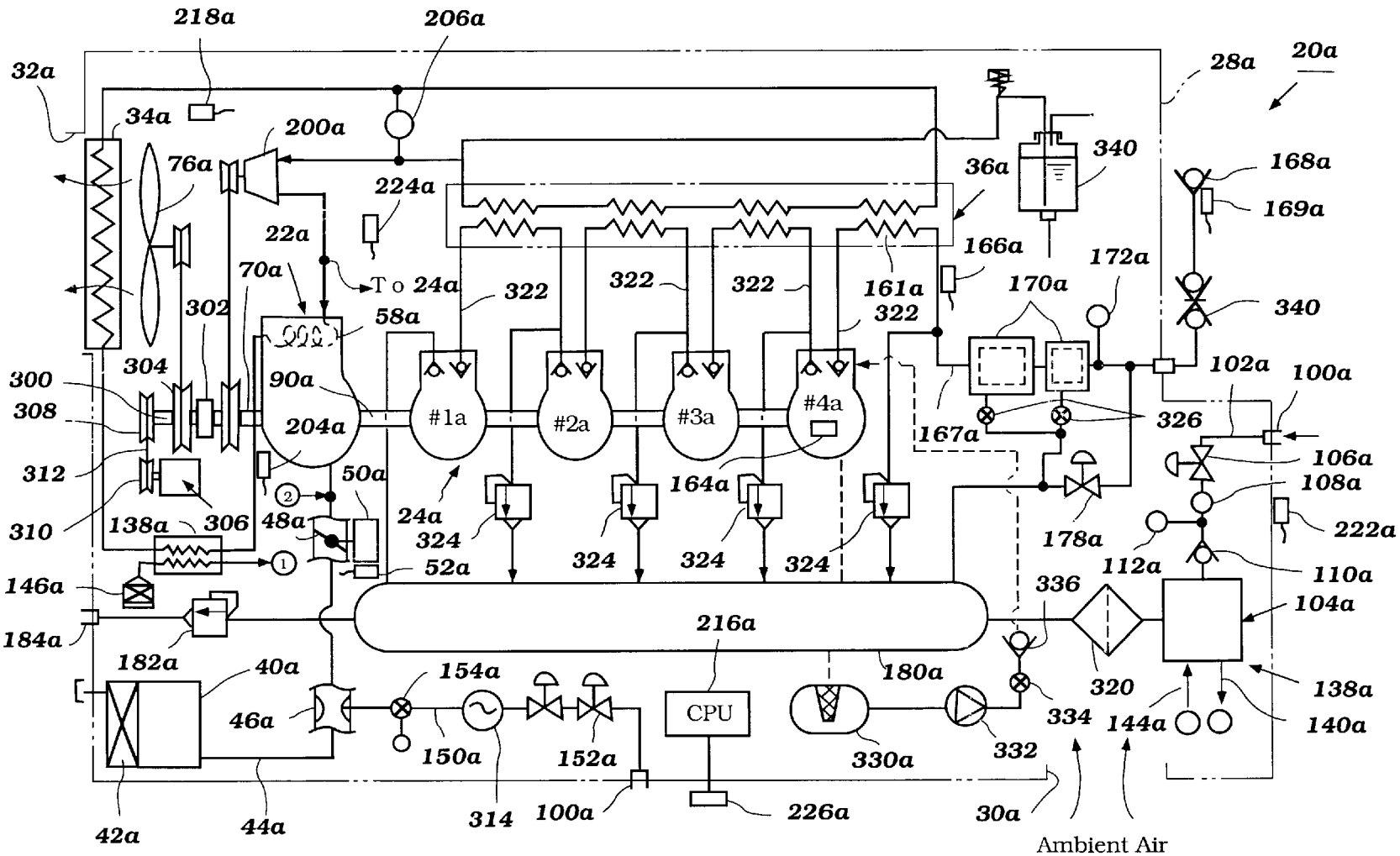
FIG. 7 is a schematic illustration of another gas filling apparatus configured and arranged in accordance with certain features aspects and advantages of the present invention.

With reference now to FIG. 7, another arrangement of a filling apparatus having certain features, aspects and advantages in accordance with the present invention is illustrated therein. As the tilling apparatus of FIG. 7 includes many of the same components as the filling apparatus of FIG. 1, like reference numerals will be used to reference to like components with the addition of the suffix "a" in FIG. 7. While many of the same components are used, the construction of the device in FIG. 7 varies in several areas from the device in FIG. 1.

Importantly, the filling apparatus 20*a* of FIG. 7 employs a variable transmission to drive the main ventilation fan 76*a* such that the flow rate of ambient air through the case 28*a* can be controlled irrespective of the operational speed of the engine 22*a* and the compressor 24*a*. Additionally the air flow created by the fan 76*a* is forced through the radiator 34*a* and the radiator 34*a* forms a portion of a water cooling system used to cool the gas passing through the compressor 24*a*. Thus, the cooling efficiency of the filling apparatus 22*a* can be adjusted by increasing, or decreasing the air flow through the case 28*a* such that the rate of heat transfer away from the radiator 34*a*, and thus the compressed gas, can be altered.

With reference now to FIG. 7, the filling apparatus generally comprises the internal combustion engine 22*a* and a compressor 24*a*. The internal combustion engine 22*a* powers the compressor 24*a* through any suitable coupling arrangement (not shown). While the arrangement of FIG. 1 features the clutching arrangement 26, the engine 22*a* of FIG. 7 preferably is directly coupled to the compressor shaft 90*a*.

With continued reference to FIG. 7, the illustrated casing 28*a* includes an ambient air intake duct 30*a* and an exhaust duct 32*a*. Air flowing in through the intake duct 30*a* is used for combustion and used to cool various components. In the filling machine 20*a* the air is forced through a radiator 34*a* by the exhaust fan 76*a*, as described above. At least a portion of the ambient air is drawn over the engine 22*a* and/or used to otherwise ventilate a chamber defined by the casing 28*a*. In addition, at least a portion of the ambient air is drawn into an induction system of the engine for combustion with the fuel. As each of these systems were generally described above, the flow paths and any substantial deviations will now be described.

With continued reference to FIG. 7, the engine 22 draws air through an intake box 40*a* that preferably includes an air filter 42*a*. Air drawn into the air intake box 40*a* is sucked through an intake pipe 44*a* and over a fuel-mixing device 46*a*. Fuel is supplied to the fuel-mixing device 46*a* in a manner that will be described below. A throttle valve 48*a* regulates the flow rate of the air/fuel mixture through the intake pipe 44*a*.

Movement of the illustrated throttle valve 48*a* desirably is controlled by an operator or control unit through a drive motor 50*a*. The motor 50*a* is designed to cycle the throttle valve 48*a* between positions by moving the throttle shaft. A throttle position sensor 52*a* can be attached to the motor 50*a* or to the throttle valve 48*a* in such a manner that the position or a change of position is registered by a controller 53*a*. The controller 53*a*, in turn, can control the relative positioning of the throttle valve by manipulating the motor 50*a*.

The air/fuel charge passes into the engine 22*a* for combustion and at least a portion of the engine 22*a* includes coolant jackets that allow coolant to course through the engine 22*a* to draw heat away from the engine 22*a*. The coolant jackets, represented schematically in FIG. 7 and identified by the reference numeral 58*a*, form a portion of a cooling system that will be described in greater detail below.

While not illustrated, the engine also includes a suitable ignition system. The ignition system is used to ignite the air/fuel charge that is intermittently transferred into the combustion chambers. The ignition system operates in any known manner and can be advanced or delayed as desired. Preferably, an ignition control circuit is controlled by the controller 53*a* depending upon the desired operating characteristics for the engine 22*a*.

A first end of the illustrated crankshaft 70*a* carries a first pulley 74*a*. The first pulley is used to power a water pump 200*a* in the illustrated arrangement. Of course, the water pump 200*a* can also be electrically driven or driven through any other suitable mechanical arrangement. A transmission shaft 300 is coupled to the crankshaft 70*a* through a suitable clutching arrangement. In the illustrated filling apparatus 20*a*, the transmission shaft 300 is coupled to the crankshaft 70*a* with a one-way clutch 302. Such an arrangement ensures that the transmission shaft does not overdrive the crankshaft 70*a* due to forces exerted on the fan 76*a*.

A variable speed transmission arrangement 304 is used to connect the fan 76*a* to the transmission shaft 300. Preferably., the variable speed transmission arrangement 304 is of the continuously variable speed transmission type and, more preferably, the variable speed transmission arrangement 304 is of the continuously variable speed belt drive type. Of course, other types of continuously variable speed transmission arrangements also can be used and other types of shiftable transmission arrangements can be used. The belt drive, however, aids in flexibly positioning the fan relative to the output shaft 70*a* and the radiator 34*a*.

The transmission shaft 300 also drives a generator (i.e., a rotor) 306 to generate electrical power for various components of the fill apparatus 20*a*. In the illustrated arrangement, the transmission shaft carries a drive pulley 308 that drives a driven pulley 310 with a flexible transmitter 312, such as a belt. It should be recognized that other drive arrangements also could be used.

The rotational power of the crankshaft 70*a* drives the compressor 24*a* and powers the positive displacement type compression pumps 94*a* (i.e. #1*a*, #2*a*, #3*a* and #4*a*). More specifically, the input shaft 90*a* drives the pumps 94*a* in any suitable manner such as through a connecting rod and piston arrangement similar to that featured in the reciprocating internal combustion engine described above. The pumps 94*a* preferably are arranged in sequence and develop increasings pressure in steps. For instance, pump #1*a* and generates a first pressure while pump #2*a* generates a second pressure that is higher than the first pressure. Pump #3*a* and pump #4*a* also incrementally increase the pressure such that a large pressure differential can be accomplished between the intake into pump #1*a* and the outlet of pump 94*a*.

With continued reference now to FIG. 7, a gas flow path through the filling apparatus 20*a* will be described in detail prior to describing the operation of the illustrated filling apparatus 20*a*. Natural gas is introduced into the illustrated filling apparatus 20*a* through a pair of inlet ports 100*a*. As illustrated, in this arrangement, one inlet port 100*a* is provided along the lower side while the other inlet port 100*a* is provided along the right side. The two ports separately supply gas to the engine 22*a* and to the compressor 24*a* rather than having both components draw from the same supply line.

The engine gas flows through a pair of pressure reducing adjustment valves 152*a* and through a flow meter 314 while flowing through the fuel gas supply pipe 150*a*. In addition, the flow through the supply pipe 150*a* is controlled by a control valve 154*a*. Downstream of the control valve 154*a*, the gas is introduced into the induction system through the mixing device 46*a*.

The compressor gas flows through the inlet port 100*a* into a first line 102*a*. The first line 102*a* generally connects the port 100*a* to a dehumidifier 104*a*; however, between the port 100*a* and the dehumidifier 104*a* are positioned a gas supply control valve 106*a*, a gas flow meter 108*a* and a check valve 110*a*. Preferably, a first or inlet gas line pressure sensor 112*a* is also positioned along the first line 102.

As described above flow patterns can be altered within the dehumidifier 104*a* and flow can be shifted into a heater 138*a*. The flow from the dehumidifier 104*a* through inlet pipe 140*a* is transferred into the heater 138*a* after passing through an air cleaner 146*a*. Following circulation through the heater 138*a*, the heated gas is returned to the dehumidifier 104*a* through return pipe 144*a* at an elevated temperature. The gas within the dehumidifier 104*a* is selectively released into a filter 320 in manners described above. The filter preferably removes the heated water vapor from the gas and releases the water vapor from the system in any suitable manner.

From the filter 320, the gas flows into a large water vapor filter element tank 180*a*. This tank is connected to the ambient air through a safety valving arrangement 182*a* and a relief port 184*a*. This tank also supplies gas to the first of the compressor pumps 94*a*. As illustrated, between each compression cycle, the gas flows through a heat exchanger 36*a*, which forms a portion of a cooling system that will be described below. Also, each of the transfer conduits 322 include a safety vent 324 that releases gas into the blow-down tank in the event of a large pressure spike. Moreover, as described above, the tank 180*a* allows the pressure on the high-pressure side of the final compressor pump94*a* (i.e. #4*a*) to be lowered such that the receiving vessel can be attached to and removed from the apparatus 20*a* more easily.

Downstream of the final compressor pump 94*a* (i.e., 94*a*), the compressed gas flows past a second temperature sensor 166*a*, which outputs a signal to the controller 53*a*, and through an oil filter 170*a*. In the illustrated arrangement, a pair of filters are shown. The increased filtering in the illustrated arrangement is desired because the oil selectively returns to the accumulator tank 180*a* and, thus, the gas flowing through the tank prior to compression may pick up a portion of the oil and carry the oil through the compressor. A set of oil drain valves 326 control the return of oil back to the blow-down tank 180*a*. Preferably, the valves are only opened when the blow-down control valve 178*a* is opened. Thus, the oil is returned from the filter to the blow-down tank 180*a* when the valve 178*a* is opened. In some cases, this occurs only when changing receiving vessels.

The blow-down tank 180*a* includes a settling tank portion 330. From the settling tank portion 330, oil is drawn by an oil pump 332 and transferred through an oil pressure adjusting valve 334 and a check valve 336 to the fourth compressor pump #4*a*. Preferably, the tank 180*a* is formed in a crankcase of the pump 94*a* in the region associated with pump #4. The increased lubrication is preferred in pump #4*a* because this pump has the highest load of the four pumps during operation. Of course other arrangements are also anticipated and the supply of lubricant can be varied depending upon the design of the compressor. In at least one arrangement, however, the oil pressure adjusting valve 334 can be controlled by the controller 53*a*.

Downstream of the oil filter 170*a*, the compressed natural gas is transferred through the high-pressure line 167*a* to a storage vessel through a filling coupling socket 168*a*. Interposed between the filling coupling socket 168*a* and the oil filter 170*a* are a final pressure sensor 172*a* and an outlet flow volume meter 174*a*. Additionally, a vessel connection confirmation sensor 169 and an emergency separation coupler 340 are also provided. The emergency separation coupler 340 allows the filling coupler socket 168*a* and the connecting conduit to be separated in case of a fire. By separating the conduit and socket, the fire can better be safely extinguished. Of course, any other suitable precautions can also be taken.

Additionally, a branch 176*a* extends from high pressure line 167*a* to the blow-down tank 180*a*. A blow-down control valve 178*a* selectively separates the high pressure line 167*a* from the tank 180*a*, which is at a much lower pressure.

With continued reference to FIG. 7, the water cooling system that is used to cool the compressor 24*a*, the engine 22*a* and the heat exchanger 36*a* will be described in greater detail. As discussed above, the water pump 200*a* circulates water throughout the cooling plumbing. The pump 200*a* circulates the coolant through the engine 22*a* and the compressor 24*a*. As the coolant exits the engine 22*a* and the compressor 24*a*, the temperature of the coolant is monitored by a third temperature sensor 204*a*. The temperature sensor 204*a* transmits its output to the controller 53*a*.

The coolant then passes through the heater 138*a* and, due to its elevated temperature, is used to condition the gas flowing through the heater 138*a*. Next. the coolant is passed through the radiator 34*a* for cooling. Of course, a portion of the coolant could be diverted away from the radiator in some situations. In the illustrated arrangement however, the thermostat 206*a* is located downstream of the radiator 34*a* and the thermostat 206*a* is used to alter the temperature of coolant entering the heat exchanger 36*a*.

As illustrated, the cooling system also features an overflow or supply reservoir 340. The reservoir 340 allows coolant to overflow into the tank as the volume in the system expands and also allows coolant to be drawn back into the system as the volume in the system contracts. Moreover, the coolant contained within the reservoir 340 aids in heat transfer out of the system to a small degree.

The filling apparatus 20*a* also can comprise an ambient air temperature sensor 222*a* and an inner chamber temperature sensor 224*a* to detect the corresponding temperatures during use. The temperatures of both the ambient air and the operating temperature of the inner chamber both can have an impact on the requisite pressure to be achieved through the present filling device such that a substantially complete fast fill can result. Moreover, the filling apparatus 20*a* also includes an on-off switch 226*a* that renders the apparatus 20*a* operational or not operational. Both of the temperature sensors 222*a* 224*a* and the switch 226*a* are in communication with the controller 53*a* to send their respective signals to the controller 53*a*. The controller 53*a* then controls various operations of the apparatus 20*a* based upon generally the same routine as described above.

While the apparatus of FIG. 1 sought to control the temperature of the compressed gas by varying the engine speed of the engine, the apparatus of FIG. 7 generally alters the speed of the cooling fan to change the degree of heat transfer from the compressed gas. Thus, by increasing the cooling fan speed, the temperature of the compressed gas generally is decreased and by slowing the cooling fan speed, the temperature of the compressed gas generally is increased.

Figure 8:
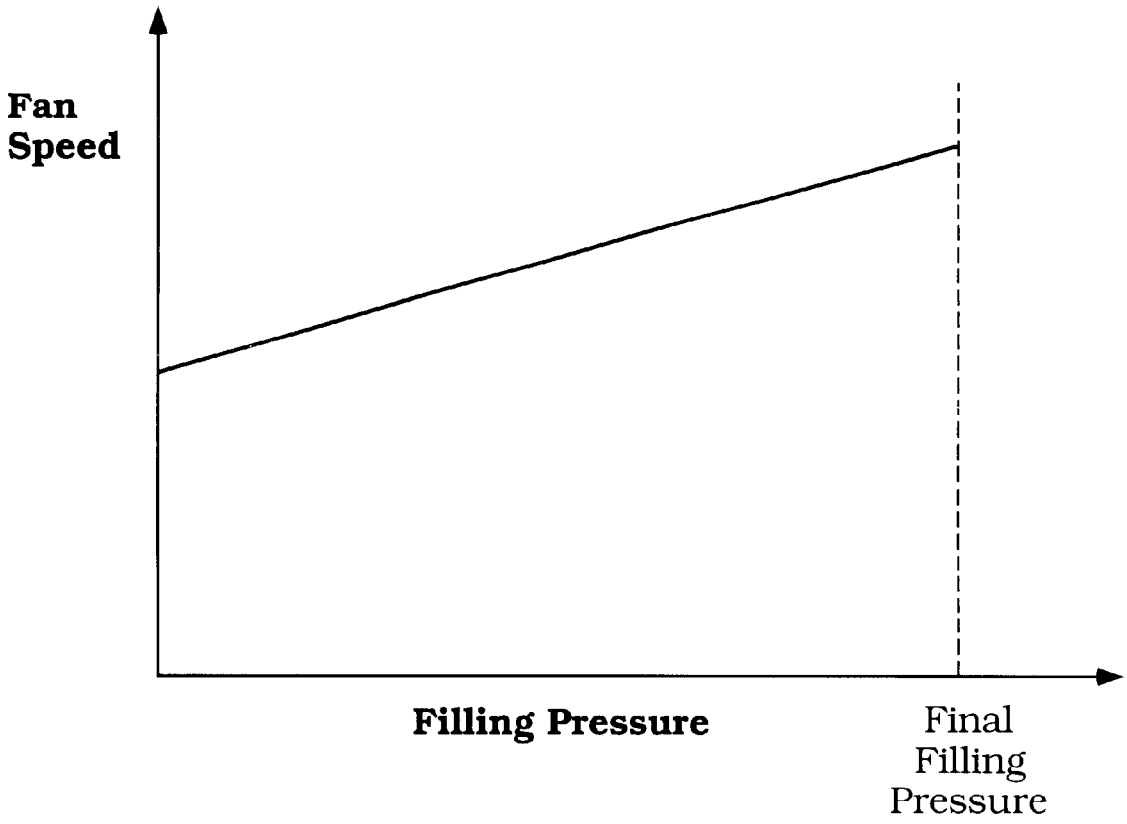
FIG. 8 is a graphical depiction of a preferred relationship of fan speed with respect to increasing filling pressure within a receiving vessel.

This relationship is best illustrated in FIG. 8. As compared to the graph depicted in FIG. 5 the fan speed is preferably increased in a fairly consistent manner while the pressure within the receiving, vessel increases rather than being increased and decreased with the increase in pressure. This is explained, in pal, by the generally constant operating speed of the compressor in the arrangement of FIG. 7 while the operating speed of the compressor in the arrangement of FIG. 1 varies with the speed of the engine.

Figure 9:
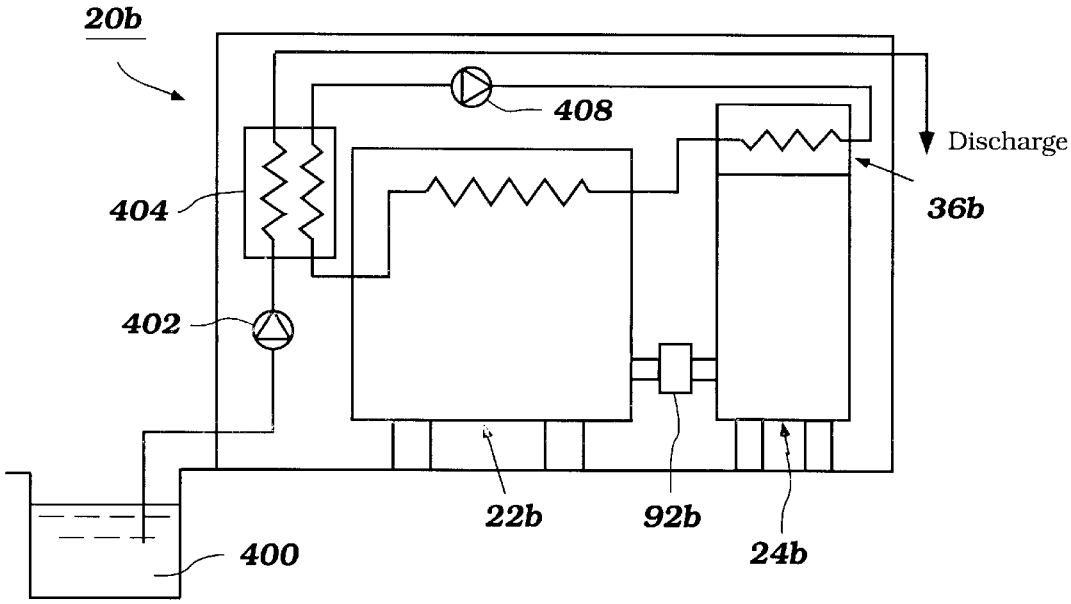
FIG. 9 is a schematic illustration of another gas filling apparatus having a cooling arrangement configured and arranged in accordance with certain features, aspects and advantages of the present invention.
Figure 10:
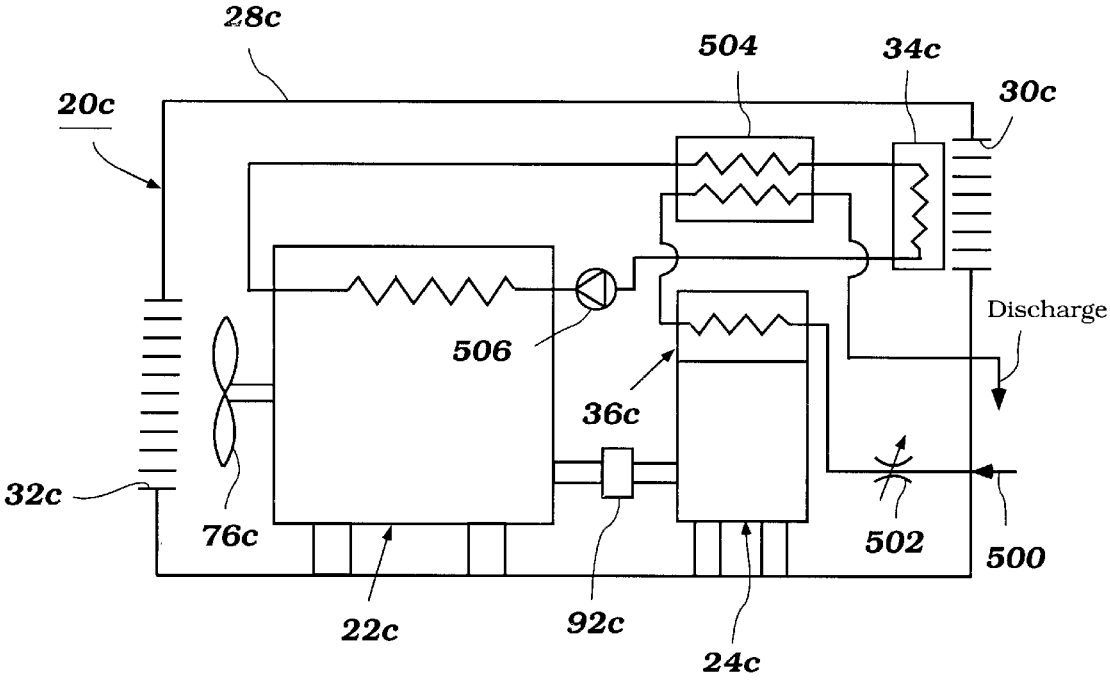
FIG. 10 is a schematic illustration of another gas filling apparatus having a further cooling arrangement configured and arranged in accordance with certain features aspects and advantages of the present invention.

With reference now to FIGS. 9 and 10, two alternative cooling, systems are disclosed. With reference first to FIG. 9, the cooling system include a large reservoir 400 from which coolant is pumped by a coolant pump 402. The coolant is then passed through a heat exchanger 404 where it absorbs heat transferred from a second cooling loop 406 prior to being exhausted from the apparatus 20*b*. The second cooling loop 406 is a closed loop that includes a separate coolant pump 408. The coolant in the second cooling loop 406 is used to cool the gases in the heat exchanger 36*b* and to subsequently cool both the compressor 24*b* and the engine 22*b*. Through the use of this systems the cooling efficiency of the cooling system is greatly increased over that of the forced air arrangement of FIG. 7 due to the ability to water cool the heat exchanger 404.

With reference now to FIG. 10, another variation on the cooling system is illustrated therein. In this arrangement, the engine 22*c* is cooled using a closed cooling system while the heat exchanger 36*c* is cooled through an open cooling system. More specifically coolant is supplied from a coolant supply 500 through a controller controlled or manually controlled flow control valve 502. This coolant flows through the heat exchanger 36*c* and cools the gas undergoing compression and then flows through a second heat exchanger 504 prior to being discharged.

The closed system includes a coolant pump 506 that continuously recirculates coolant through the cooling loop. The coolant passes through and cools the engine 22*c*, and while not illustrated, can cool the compressor 24*c* as well. The coolant leaves the engine 22*c* and flows through the heat exchanger 504 prior to flowing through a further radiator 34*c*. Air is drawn into the chamber defined by the case 28*c* through the ambient air inlet duct 30*c* by the fan 76*c*. The fan exhausts the air from the chamber through the exhaust duct 32*c*. The air flow through the chamber created by the fan 76*c* is used to at least partially cool the closed loop using the radiator 34*c*. The closed loop then can be further cooled by the coolant flowing through the open loop or the closed loop can be used to cool the coolant flowing through the open loop prior to the coolant being discharged.

It should be apparent to those of ordinary skill in the art, in view of the above description, that the present invention affords many benefits over the compressor arrangements currently in use. For instance, the present invention yields an advantageously compact system for rapidly transferring natural gas from a first pressure to a second pressure and for preparing transportable high pressure canisters of natural gas from a lower temperature supply. In addition, the present invention forms an environmentally sound solution to the problem of how to power the compressor. Furthermore, the construction of the dehumidifier allows a portion of the water vapor entrained within the natural gas supply to be removed while natural gas vapors that are entrained with the water vapor or bypassed during the dehumidifying process with the water vapors are combusted within the engine prior to being emitted into the atmosphere.

Of course, the foregoing description is that of certain features, aspects and advantages of the present invention to which various changes and modifications can be made without departing from the spirit and scope of the present invention. For instance, various features of one filling apparatus can be easily modified for use with any of the other arrangements described above. Accordingly, swapping of various components between arrangements is fully contemplated. Moreover, a filling apparatus need not feature all features, aspects or advantages of the present invention to use certain features, aspects and advantages of the present invention. Furthermore, one advantage or a group of advantages could be optimized over other advantages. The present invention, therefore, should only be defined by the appended claims.

What is claimed is:

1. A natural gas filling apparatus comprising an engine and a compressor, said engine comprising an induction system and an exhaust manifold, said apparatus also comprising an inlet nozzle and a dehumidifier being connected to said inlet nozzle through a first gas supply pipe, a second gas supply pipe extending between said compressor and said dehumidifier, said dehumidifier comprising a first moisture absorbing filter and a second moisture absorbing filter, a heated air supply being connected to said first filter and said second filter, a heated air return being connected to said induction system, a first switching portion being interposed between said first gas supply pipe, said heated air supply and said first and second moisture absorbing filters, a second switching portion being interposed between said second gas supply pipe, said heated air return and said first and second moisture absorbing filters, said first portion and said second portion selectively connecting said first gas supply pipe and said second gas supply pipe to one of said first filter and said second filter and said heated air supply and said heated air return to the other of said first filter and said second filter, said compressor comprising multiple compression stages and communicating with a delivery conduit, said delivery conduit connecting said compressor to an outlet socket, a gas cooling heat exchanger interposed between at least a portion of said compressor and said delivery conduit and a pressure sensor communicating with said delivery conduit.

2. The apparatus of claim 1, wherein said heat exchanger is air cooled.

3. The apparatus of claim 1, wherein said heat exchanger is liquid cooled.

4. The apparatus of claim 3, wherein said heat exchanger is liquid cooled by a closed loop cooling system.

5. The apparatus of claim 4, wherein said closed loop cooling system is cooled by a second heat exchanger.

6. The apparatus of claim 3, wherein said heat exchanger is liquid cooled by an open loop cooling system.

7. The apparatus of claim 6, wherein said open loop cooling system is cooled by a second heat exchanger.

8. The apparatus of claim 1 further comprising a fuel-mixing device being positioned along said induction system and a third gas supply pipe extending between said dehumidifier and said fuel-mixing device.

9. The apparatus of claim 1 further comprising a controller, said pressure sensor being capable of outputting a pressure-indicating signal to said controller and said controller being adapted to control a speed of said engine depending upon said pressure-indicating signal.

10. The apparatus of claim 1 further comprising a fan disposed to increase an air flow over said heat exchanger and also comprising a controller said pressure sensor being capable of outputting a pressure-indicating signal to said controller and said controller being adapted to control a speed of said fan depending upon said pressure-indicating signal.

11. The apparatus of claim 1, wherein air within said heated air supply is heated within said exhaust manifold.

12. A natural gas filling apparatus comprising an engine, a compressor driven by the engine, the compressor comprising a multiple stage positive displacement compressor and a gas cooling heat exchanger, an outlet valve being adapted to selectively fill removable receiving vessels with compressed gas, a delivery conduit connecting said compressor to said outlet valve, a pressure sensor positioned along said delivery conduit, said pressure sensor being in communication with and inputting a pressure signal to a controller, said controller being configured to control an operational characteristic of said compressor when said pressure signal indicates an increase in pressure.

13. The apparatus of claim 12, wherein said controller is connected to said pressure sensor, said controller receiving an output signal from said pressure sensor and being adapted to determine a difference between said pressure signal and a preset final filling pressure, said controller being adapted to control a compression speed based on said difference and being adapted to decrease said compression speed if said difference is less than a preset difference.

14. The apparatus of claim 13, wherein a flow rate through said delivery conduit increases as said compression speed decreases.

15. The apparatus of claim 13 further comprising an engine speed sensor being connected to said controller and being adapted to output a signal indicative of an engine speed to said controller, and said controller controlling said compression speed by altering said engine speed.

16. The apparatus of claim 15, wherein said engine speed is controlled by altering a flow rate through an induction system associated with said engine in accordance with a map of present operating conditions that correspond to a pressure that is detected by said pressure sensor.

17. The apparatus of claim 15, wherein said engine speed is controlled according to a map of preset operating conditions that correspond to a detected pressure.

18. The apparatus of claim 12 further comprising a casing surrounding at least a portion of said gas cooling heat exchanger, a fan arranged to draw an air flow through said casing across at least a portion of said gas cooling heat exchanger, said engine driving said fan at variable rates and a cooling effect of said gas cooling heat exchanger being increased by increasing a speed of said fan.

19. The apparatus of claim 18, wherein said engine drives said fan through a variable speed transmission.

20. The apparatus of claim 18, wherein said engine directly drives said fan and said speed of said fan is increased by increasing a speed of said engine.

21. The apparatus of claim 18, wherein said controller is adapted to control said fan and said controller increases a speed of said fan as a pressure detected by said pressure sensor increases.

22. The apparatus of claim 21, wherein said controller increases said speed of said fan by increasing said speed of said engine.

23. The apparatus of claim 21, wherein said controller increases said speed of said fan by controlling shifting of said variable speed transmission.

24. A natural gas filling apparatus comprising an engine, a compressor driven by the engine, and a gas cooling heat exchanger, the compressor comprising a multiple stage compressor, an outlet valve being adapted to selectively fill a removable receiving vessel with compressed gas from said compressor, a delivery conduit connection said compressor to said outlet valve, means for detecting a degree to which the vessel is filled with compressed gas, and means for adjusting a temperature of said gas being delivered to the vessel through said delivery conduit in response to the degree to which the vessel is filled with compressed gas.

25. The apparatus of claim 24, wherein said adjusting means controls a compressed gas dwell time within a heat exchanger.

26. The apparatus of claim 25, wherein said adjusting means controls said dwell time by controlling, an operating speed of said compressor.

27. The apparatus of claim 26, wherein said adjusting means controls said operating speed of said compressor by controlling a speed of said engine.

28. The apparatus of claim 24, further comprising a fan disposed to increase an air flow rate over a heat exchanger and said adjusting means controlling said fan to control said air flow rate.

29. The apparatus of claim 28, wherein said adjusting means controls said fan by controlling a speed of said engine.

30. The apparatus of claim 28, further comprising a variable speed transmission through which said engine drives said fan and said adjusting means controlling said fan by controlling said variable speed transmission.

31. A natural gas filling apparatus comprising:

a multiple stage positive displacement compressor driven by an engine;

a gas cooling heat exchanger;

an outlet valve being adapted to selectively fill removable receiving vessels with compressed gas;

a delivery conduit placing said compressor in fluid communication with said outlet valve and having a pressure sensor positioned along said conduit;

said pressure sensor being adapted to provide a pressure signal to a controller, said controller being configured to control an operational characteristic of said compressor when said pressure sensor indicates an increase in pressure in the delivery conduit.

32. The apparatus of claim 31, wherein said controller is configurable to contain a preset final filling pressure and said controller is adapted to determine a difference between said pressure signal from said sensor and said preset final filling pressure, said controller being adapted to control a compression speed of the compressor based on said pressure difference, and being adapted to decrease said compression speed if said difference is less than a preset difference.

33. The apparatus of claim 32, wherein a flow rate through said delivery conduit increases as said compression speed decreases.

34. The apparatus of claim 33 further comprising an engine speed sensor being connected to said controller and being adapted to output a signal indicative an engine speed to said controller, and said controller controlling said compression speed by altering said engine speed.

35. The apparatus of claim 34, wherein said engine speed is controlled by altering a flow rate through an induction system associated with said engine in accordance with a map of present operating conditions that correspond to a pressure that is detected by said pressure sensor.

36. The apparatus of claim 34, wherein said engine speed is controlled according to a map of preset operating conditions that correspond to a detected pressure.

37. The apparatus of claim 31 further comprising a casing surrounding at least a portion of said gas cooling heat exchanger, a fan arranged to draw an air flow through said casing across at least a portion of said gas cooling heat exchanger, said engine driving said fan at variable rates and a cooling effect of said gas cooling heat exchanger being increased by increasing a speed of said fan.

38. The apparatus of claim 37, wherein said engine drives said fan through a variable speed transmission.

39. The apparatus of claim 37, wherein said engine directly drives said fan and said speed of said fan is increased by increasing a speed of said engine.

40. The apparatus of claim 37, wherein said controller is adapted to control said fan and said controller increases a speed of said fan as a pressure detected by said pressure sensor increases.

41. The apparatus of claim 40, wherein said controller increases said speed of said fan by increasing said speed of said engine.

42. The apparatus of claim 40, wherein said controller increases said speed of said fan by controlling shifting of said variable speed transmission.

43. A natural gas filling apparatus comprising:

a multiple stage positive displacement compressor driven by an engine;

a gas cooling heat exchanger;

an outlet valve being adapted to selectively fill removable receiving vessels with compressed gas;

a delivery conduit placing said compressor in fluid communication with said outlet valve and having a pressure sensor positioned therealong;

means for detecting a degree of remaining compressed gas capacity of the vessel;

means for adjusting a temperature of said gas being delivered to the vessel through said delivery conduit in response to the degree of remaining compressed gas capacity of the vessel.

44. The apparatus of claim 43, wherein said adjusting means controls a compressed gas dwell time within a heat exchanger.

45. The apparatus of claim 44, wherein said adjusting means controls said dwell time by controlling an operating speed of said compressor.

46. The apparatus of claim 45, wherein said adjusting means controls said operating speed of said compressor by controlling a speed of said engine.

* * * * *

UNITED STATES PATENT AND TRADEMARK OFFICE

CERTIFICATE OF CORRECTION

PATENT NO. : 6,360,793 B1 
DATED : March 26, 2002
INVENTOR(S) : Hisayuki Sugano, Masami Saruta and Hajime Kishida It is certified that error appears in the above-identified patent and that said Letters Patent is hereby corrected as shown below:

Title page,
Add the priority data to the grant,
-- [30] Foreign Application Priority Data
Feb. 8, 1999 (JP).....11-030607 --

Signed and Sealed this

Twelfth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,360,793 B1
DATED : March 26, 2002
INVENTOR(S) : Sugano et al.

It is certified that error appears in the above-identified patent and that said Letters Patent is hereby corrected as shown below:

Column 20,
Line 5, (2nd occurrence) "heated" should be -- heat --

Column 21,
Line 42, "connection said" should be -- connecting said --
Line 59, "heat exchanger" should be -- heat exchange --

Signed and Sealed this

Nineteenth Day of August, 2003

JAMES E. ROGAN
*Director of the United States Patent and Trademark Office*